US007448363B1

(12) United States Patent
Rasmussen et al.

(10) Patent No.: US 7,448,363 B1
(45) Date of Patent: Nov. 11, 2008

(54) FUEL DELIVERY SYSTEM AND METHOD OF OPERATION

(75) Inventors: Matt Rasmussen, Milwaukee, WI (US); Daniel Hurda, Mequon, WI (US)

(73) Assignee: Buell Motorcycle Company, East Troy, WI (US)

( * ) Notice: Subject to any disclaimer, the term of this patent is extended or adjusted under 35 U.S.C. 154(b) by 0 days.

(21) Appl. No.: 11/772,282

(22) Filed: Jul. 2, 2007

(51) Int. Cl.
*F02M 37/04* (2006.01)
*F02D 41/06* (2006.01)

(52) U.S. Cl. ..... 123/497; 123/516; 123/179.17

(58) Field of Classification Search ..... 123/357, 123/516, 497, 179.16, 179.17
See application file for complete search history.

(56) References Cited

U.S. PATENT DOCUMENTS

| | | | | |
|---|---|---|---|---|
| 4,728,264 | A | 3/1988 | Tuckey | |
| 4,756,291 | A | 7/1988 | Cummins et al. | |
| 4,951,636 | A | 8/1990 | Tuckey et al. | |
| 5,088,464 | A | 2/1992 | Meaney | |
| 5,174,263 | A | 12/1992 | Meaney | |
| 5,237,975 | A | 8/1993 | Betki et al. | |
| 5,355,859 | A | 10/1994 | Weber | |
| 5,406,922 | A | 4/1995 | Tuckey | |
| 5,458,104 | A * | 10/1995 | Tuckey | 123/463 |
| 5,598,817 | A * | 2/1997 | Igarashi et al. | 123/179.17 |
| 5,605,133 | A * | 2/1997 | Tuckey | 123/458 |
| 5,699,772 | A | 12/1997 | Yonekawa et al. | |
| 5,718,207 | A | 2/1998 | Ito | |
| 5,740,783 | A | 4/1998 | Learman et al. | |
| 6,186,112 | B1 * | 2/2001 | Takahashi et al. | 123/198 D |
| 6,240,902 | B1 | 6/2001 | Tanaka et al. | |
| 6,357,422 | B1 | 3/2002 | Doane et al. | |
| 6,408,825 | B1 * | 6/2002 | Enoki et al. | 123/467 |
| 6,431,838 | B2 | 8/2002 | Tanaka et al. | |
| 6,450,148 | B2 * | 9/2002 | Nakamura et al. | 123/464 |
| 6,474,294 | B2 * | 11/2002 | Yamazaki et al. | 123/295 |
| 6,539,921 | B1 * | 4/2003 | Matsumura | 123/456 |
| 6,609,501 | B2 | 8/2003 | Doane et al. | |
| 6,755,183 | B2 * | 6/2004 | Frech et al. | 123/491 |
| 6,925,990 | B1 | 8/2005 | Konopacki | |
| 7,222,611 | B2 * | 5/2007 | Sekiya et al. | 123/514 |
| 7,267,108 | B2 * | 9/2007 | Barylski et al. | 123/457 |
| 7,316,219 | B2 * | 1/2008 | Yamaguchi et al. | 123/431 |
| 2003/0075155 | A1 * | 4/2003 | Frech et al. | 123/491 |
| 2005/0257779 | A1 | 11/2005 | Knight et al. | |
| 2005/0284448 | A1 | 12/2005 | Forgue et al. | |

* cited by examiner

*Primary Examiner*—Thomas N Moulis
(74) *Attorney, Agent, or Firm*—Michael Best & Friedrich LLP

(57) ABSTRACT

A fuel delivery system for an engine. The fuel delivery system includes a fuel tank, at least one fuel injector, a fuel pump, a pressure sensor, a temperature sensor, and an engine control module. The fuel pump is configured to draw fuel from the fuel tank and provide the fuel to the at least one fuel injector. The pressure sensor is configured to sense a pressure of the fuel being provided to the at least one fuel injector. The temperature sensor is configured to sense a temperature of the engine. And the engine control module is configured to control the fuel pump based on the sensed pressure and the sensed temperature.

19 Claims, 5 Drawing Sheets

FUEL DELIVERY SYSTEM AND METHOD OF OPERATION

BACKGROUND

Internal combustion engines, such as used in motorcycles or automobiles, require fuel to operate. The fuel is generally stored in a fuel tank, located a distance from the engine, and is pumped to the engine. Fuel delivery systems for pumping the fuel to the engine are either closed-loop systems or open-loop systems. In an open-loop system, a fuel pump is operated at a constant rate to provide sufficient fuel to the engine for all operating conditions. When less fuel is required than is provided by the fuel pump, the excess fuel is returned to the fuel tank.

In a closed-loop system, there is no return path for fuel back to the fuel tank. Instead, the fuel pump is controlled to provide fuel to the engine at a constant pressure regardless of the quantity of fuel used by the engine.

SUMMARY

The present invention provides a closed-loop fuel delivery system that optimizes performance of and emissions from an engine by varying the pressure of fuel in a fuel line based on an operating mode and one or more engine characteristics.

In one embodiment, the invention provides a fuel delivery system including a fuel tank, at least one fuel injector, a fuel pump, a pressure sensor, a temperature sensor, and an engine control module. The fuel pump is configured to draw fuel from the fuel tank and provide the fuel to the at least one fuel injector. The pressure sensor is configured to sense a pressure of the fuel being provided to the at least one fuel injector. The temperature sensor is configured to sense a temperature of the engine. And the engine control module is configured to control the fuel pressure based on the sensed pressure and the sensed temperature.

In another embodiment, the invention provides a motorcycle including an engine, a fuel tank, a fuel delivery system, a temperature sensor, and an engine control module. The engine includes at least one fuel injector. The fuel delivery system includes a pressure sensor and a fuel pump configured to draw fuel from the fuel tank and provide the fuel to the at least one fuel injector. The temperature sensor is configured to sense a temperature of the engine and the engine control module is configured to control the fuel pump based on the sensed pressure and the sensed temperature.

In another embodiment the invention provides a method of delivering fuel to an engine. The method includes the acts of detecting a fuel pressure, detecting engine temperature, determining a fuel pressure set-point based on the detected temperature, and controlling the fuel pressure based on the detected fuel pressure and the fuel pressure set-point.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
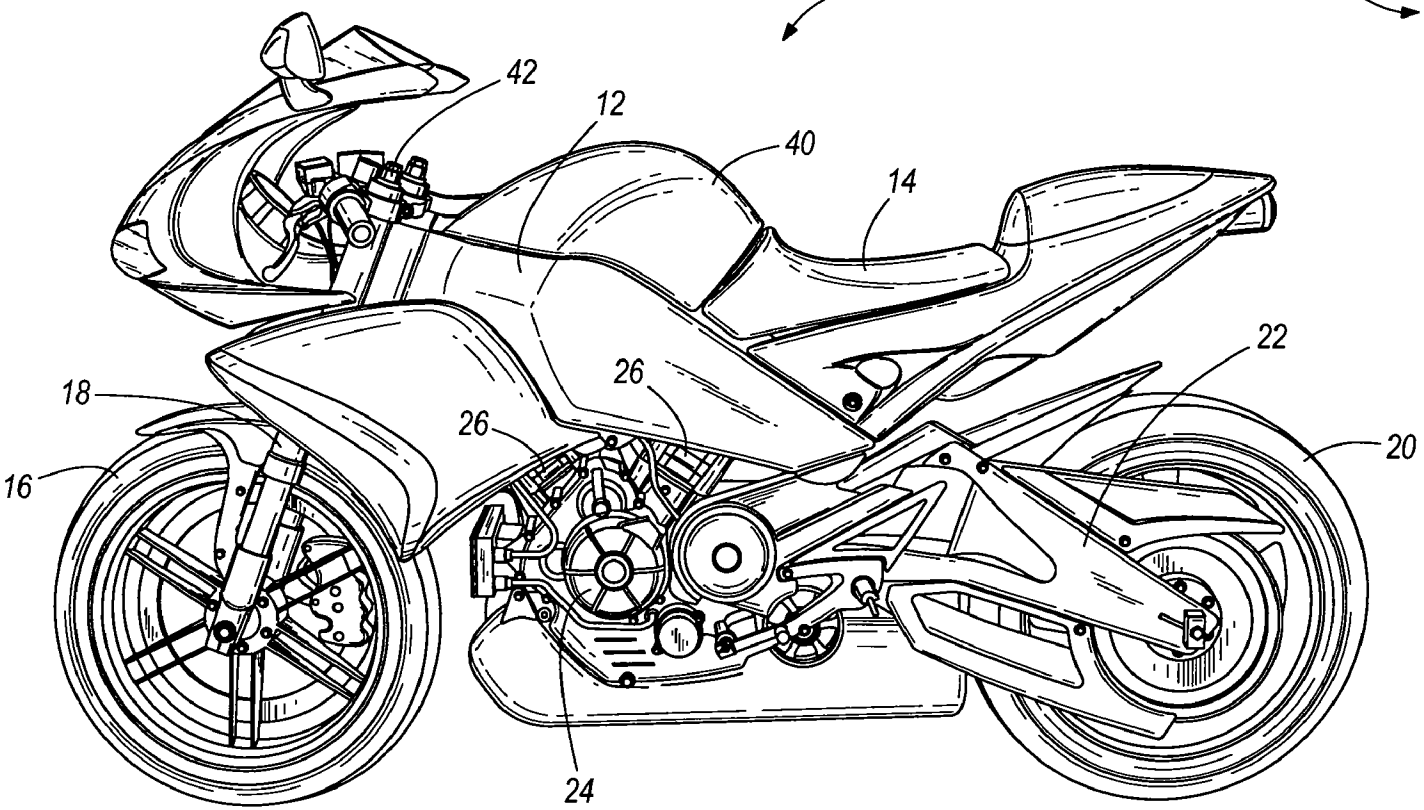
FIG. 1 illustrates a motorcycle embodying the present invention.

FIG. 1 illustrates a motorcycle 10 including a frame 12, a seat 14, a front wheel 16 supported by a front fork 18, a rear wheel 20 supported by a swing arm 22, and an engine 24. The engine 24 provides power to the rear wheel 20 through a transmission. The engine 24 includes two cylinders 26 for combusting an air-fuel mixture. In the illustrated motorcycle 10, a portion of the frame 12 comprises a fuel tank 40 that stores fuel.

Figure 2:
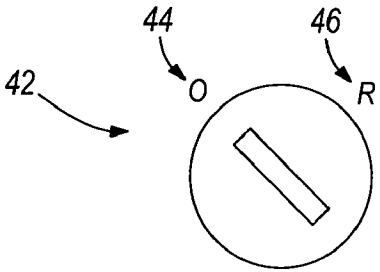
FIG. 2 schematically illustrates an ignition switch of the motorcycle of FIG. 1.

The motorcycle 10 also includes an ignition switch 42. As shown in FIG. 2, the ignition switch 42 has two positions, off 44 and run 46. An operator can use a valid key inserted in the ignition switch 42, along with a start button (not shown), to operate the motorcycle 10 in a known manner. In other embodiments, the function of the ignition switch 42 can be performed using a start button, a stop button, and a wireless security device.

Figure 3:
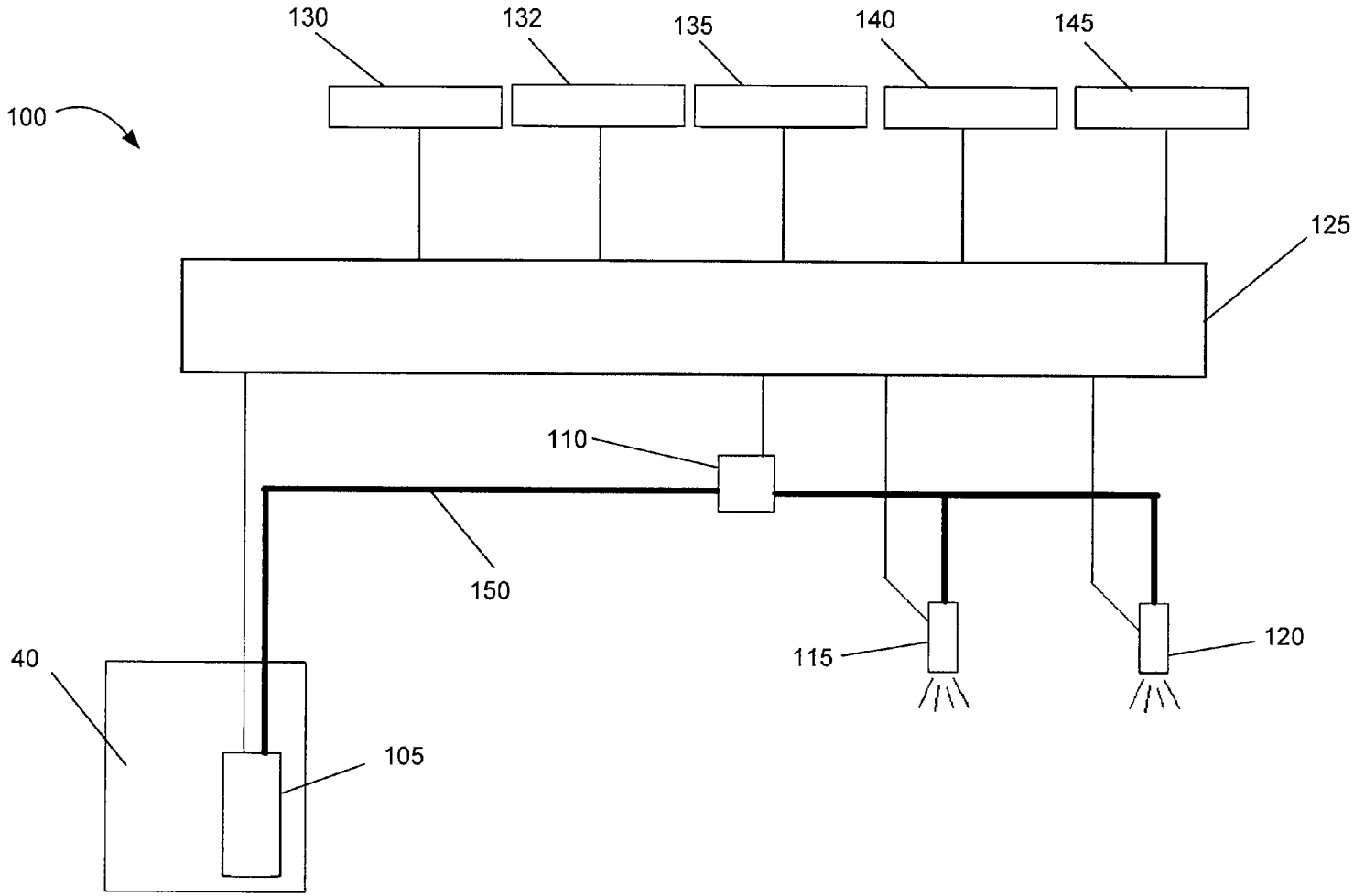
FIG. 3 illustrates a schematic diagram of a fuel delivery system embodying the present invention.

FIG. 3 is a schematic illustration of a fuel delivery system 100, according to one embodiment of the invention, for delivering fuel from the fuel tank 40 to the first and second cylinders 26. The fuel delivery system 100 includes a fuel pump 105, a fuel pressure sensor 110, a first fuel injector 115, a second fuel injector 120, an engine control module 125 ("ECM"), an ignition switch position indicator 130, a start button indicator 132, an engine temperature sensor 135, a throttle position sensor 140, and an engine speed sensor 145.

In some embodiments, the ECM 125 can be dedicated to controlling the fuel delivery system 100. In other embodiments, the ECM 125 can control other functions of the motorcycle 10 (e.g., ignition/spark) in addition to controlling the fuel delivery system 100. In the embodiment shown, the ECM 125 monitors the ignition switch position indicator 130 to determine the position of the ignition switch 42 (e.g., stop, run) and the start button indicator 132 to determine if the start button is pressed. The ECM 125 also receives an indication of the temperature of the engine 24 from the engine temperature sensor 135 (e.g., a temperature of an engine coolant). The indication can be in any suitable form, such as an analog signal, a digital signal, or an electrical resistance.

The ECM 125 also receives an indication of a throttle position from the throttle position sensor 140. The throttle position sensor 140 can provide the ECM 125 with a byte of data indicative of a percentage the throttle is open (e.g., between 0 and 100 percent). In a preferred embodiment, the throttle travels between 0 degrees (fully closed) and 85 degrees (fully open). The throttle position sensor 140 provides the byte of data with the values of 0 h when the throttle is at 0 degrees, 80 h when the throttle is at 42.5 degrees, and FFh when the throttle is at 85 degrees. In some embodiments, the throttle position sensor 140 can provide an analog signal (e.g., 0-10 volts) to indicate the position of the throttle.

The engine speed sensor 145 provides an indication of the speed of the engine 24 in rotations-per-minute ("RPM") to the ECM 125. The engine speed sensor 145 can provide the indication as an analog or a digital signal. A span of the signal can be chosen to provide sufficient precision such that the ECM 125 can accurately control the fuel delivery system 100. For example, an engine may have an operating range between 1000 RPM and 8000 RPM. If the operating precision of the fuel delivery system 100 requires precision to 1000 RPM, the engine speed sensor 145 can have a data range of 0 to 8. However, if the fuel delivery system 100 requires precision to 50 RPM, the engine speed sensor 145 can have a data range of 0 to 160.

In some embodiments, the fuel pump 105 is positioned in the fuel tank 40 of the motorcycle 10. In other embodiments, the fuel pump 105 can be positioned on an external wall of the fuel tank 40 or at a position a distance from the fuel tank 40. The fuel pump 105 receives a signal from the ECM 125 indicative of a speed and/or torque at which the fuel pump 105 should operate. The signal from the ECM 125 to the fuel pump 105 can be analog or digital. In one preferred embodiment, the signal from the ECM 125 to the fuel pump 105 is a pulse-width modulated signal having a duty cycle proportional to a desired speed/torque of the fuel pump 105.

The fuel pump 105, based on the signal received from the ECM 125, draws fuel from the fuel tank 40 and provides the fuel through a fuel line 150 to the first and second fuel injectors 115 and 120. A speed/torque of the fuel pump 105, along with a frequency and duration that the first and second fuel injectors 115 and 120 are open determines the pressure of fuel in the fuel line 150. The fuel pressure sensor 110 detects the pressure of the fuel in the fuel line 150 and provides an indication of that pressure to the ECM 125. The fuel pressure sensor 110 can provide the indication of the pressure of the fuel in the fuel line 150 as any appropriate signal, such as an analog signal, a digital signal, or an electrical resistance.

The ECM 125 sends a signal to the first and second fuel injectors 115 and 120 to control the opening and closing of each. In some embodiments, the signal is a digital signal (i.e., on or off) indicating that the fuel injector 115 or 120 should either fully open or fully close. It is anticipated that, in some embodiments, the signal from the ECM 125 to the fuel injectors 115 and 120 can be an analog or a digital signal indicating an amount the fuel injector 115 or 120 should open (e.g., 75 percent).

The ECM 125 controls the fuel pump 105 and the first and second fuel injectors 115 and 120 to optimize a quantity of fuel delivered to the engine based on engine parameter data received from the sensors and indicators (e.g., engine temperature, engine load, engine speed, etc.). The optimization of fuel delivery can, among other things, reduce exhaust emissions, improve engine performance, and/or prevent vapor lock. The fuel delivery system 100 operates in one of three modes: engine start, engine stop, or engine run. It is anticipated that, in some embodiments, the fuel delivery system 100 includes additional operating modes.

Figure 4:
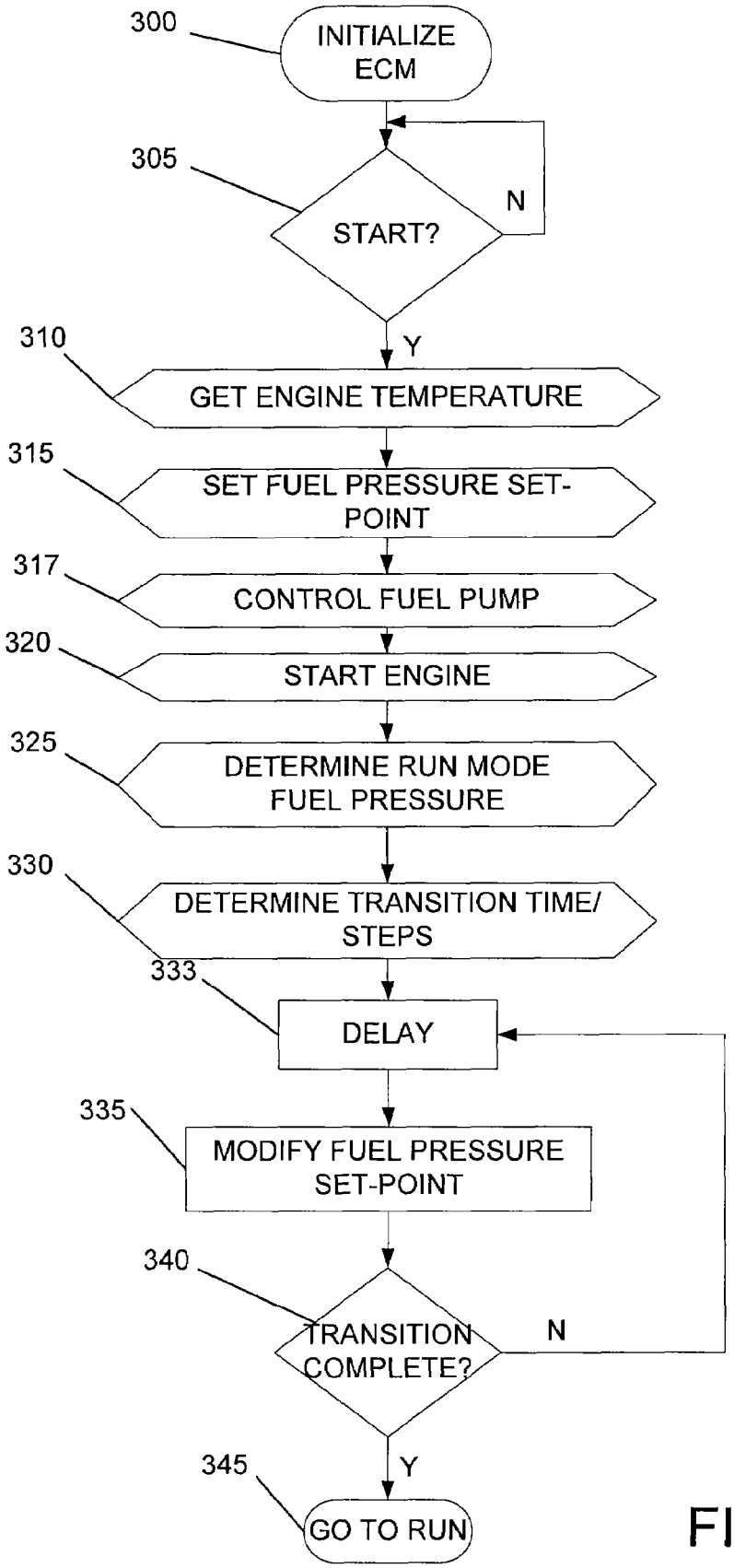
FIG. 4 illustrates a flow chart of a start routine of the fuel delivery system of FIG. 3.

FIG. 4 is a flow chart of an embodiment of the operation of the fuel delivery system 100 in the engine start mode. To operate the motorcycle 10, an operator puts a key in the ignition switch 42 which is in the off position 44. The operator turns the key to the on position 46 causing power to be applied to the ECM 125 which initializes and begins functioning (block 300). The ECM 125 monitors the ignition switch 42 and the start button to determine if the operator has turned the key to the run position 46 and pressed the start button (block 305). When the operator turns the key to the engine run position 46 and presses the start button, the ECM 125 obtains an indication of engine temperature from the temperature sensor 135 (block 310). Next, the ECM 125 determines a fuel pressure set-point, in pounds-per-square-inch ("psi"), based on the engine temperature (block 315). In some embodiments, the ECM 125 selects the pressure set-point based on a look-up table such as shown in Table 1. The fuel pressure set-point can be chosen to prevent vapor lock and to optimize a fuel droplet size to improve an atomization of the fuel, which can result in less fuel being necessary to start the engine 24.

TABLE 1

| Start Fuel Pressure | |
|---|---|
| Engine Temperature (° C.) | Fuel Pressure Set-point (psi) |
| −10 | 70 |
| 20 | 70 |
| 60 | 68 |
| 80 | 65 |

The ECM 125 then operates the fuel pump 105 to achieve and maintain the fuel pressure at the fuel pressure set-point (block 317). Once the fuel pressure is at the set-point, the ECM 125 starts the engine 24 (block 320). The fuel pressure set-point, when the engine 24 is starting, can be different from the fuel pressure set-point during normal operation (e.g., run mode). Therefore, the ECM 125 can transition from the starting fuel pressure set-point to a running fuel pressure set-point over a predetermined period of time or a predetermined number of steps. The larger the difference between the starting fuel pressure set-point and the operating fuel pressure set-point, the more time and/or steps the transition takes to complete.

The ECM 125 determines the operating fuel pressure set-point, as described in more detail below (block 325), and determines the transition time period and/or steps (block 330). Embodiments of the invention include, but are not limited to, (1) a fixed transition time period wherein the number and/or size of the steps is modified, (2) a fixed number and/or size of the steps wherein the time period can be modified, and (3) wherein the time period and the number and/or size of the steps are all modified. The ECM 125 then delays for the time period determined in block 330 (block 333), and modifies the fuel pressure set-point by the predetermined amount (block 335). Next, the ECM 125 determines if the transition period is complete (block 340) continuing by delaying at block 333 if the transition is not complete or continuing with the engine run routine (block 345) if the transition is complete.

In some embodiments, the ECM 125 can operate the fuel pump 105 to achieve and maintain a starting fuel pressure, based on engine temperature, as soon as the operator turns the key to the on position.

Figure 5:
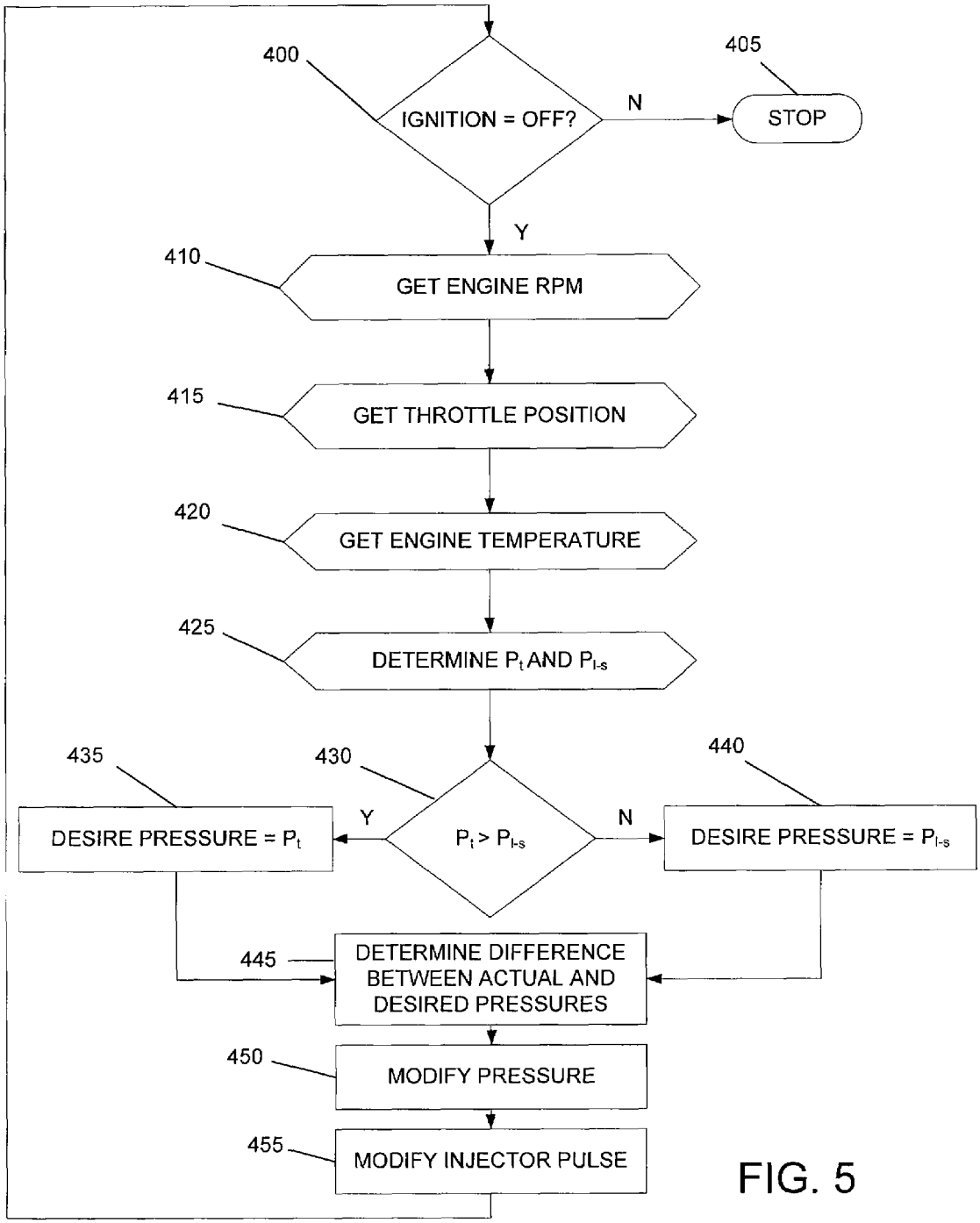
FIG. 5 illustrates a flow chart of a run routine of the fuel delivery system of FIG. 3.

FIG. 5 is a flow chart of an embodiment of an engine run routine. The ECM 125 checks whether the operator has turned the ignition switch 42 to the off position 44 (block 400). If the ignition switch 42 is in the off position 44, the ECM 125 executes a stop routine (block 405) as described in more detail below. If the ignition switch 42 is not in the off position 44, the ECM determines the engine speed (block 410) based on information from the engine speed sensor 145; the throttle position (block 415) based on information from the throttle position indicator 140; and the engine temperature (block 420) based on information from the engine temperature sensor 135. Next, the ECM 125 determines a desired fuel pressure based on the engine temperature ($P_t$) and a desired fuel pressure based on the throttle position (i.e., engine load) and the engine speed ($P_{l-s}$) (block 425). The ECM 125 can calculate the desired fuel pressures or can select the desired fuel pressures from look-up tables. Table 2 below is an exemplary look-up table for $P_t$ and table 3 is an exemplary look-up table for $P_{l-s}$.

The ECM 125 then compares the fuel pressures, $P_t$ and $P_{l-s}$ (block 430) and sets a fuel pressure set-point to the greater of $P_t$ or $P_{l-s}$ (blocks 435 and 440). For example, if the temperature of the engine 24 is 20° C., the throttle position is 10%, and the engine speed is 1000 RPM (such as when the motorcycle 10 is first started and idling), from table 2 $P_t$=58 psi and from table 3 $P_{l-s}$=0 psi. Therefore, the desired fuel pressure is 58 psi ($P_t$ is greater than $P_{l-s}$). The ECM 125 then determines the actual fuel pressure (block 445) based on information from the fuel pressure sensor 110 and compares the actual fuel pressure to the desired fuel pressure (block 450). Based on the difference between the actual and desired fuel pressures, the ECM 125, using a suitable control method (e.g., proportional-integral-derivative), increases or decreases the speed/torque of the fuel pump 105 to bring the actual fuel pressure in line with the desired fuel pressure. Next the ECM 125 sets an injector pulse-width (i.e., a time period that the injector is open) based on the actual fuel pressure (block 455). Table 4 below is an exemplary look-up table for adjusting the injector pulse-width based on the actual fuel pressure. The table indicates a percentage of normal injector pulse-width based on the fuel pressure. For example, if the actual fuel pressure is 58 psi, the injector pulse-width is not modified (i.e., is equal to 100% of the normal pulse-width). If the actual fuel pressure is 64 psi, the injector pulse-width is reduced to 95% of the normal pulse-width. The ECM 125 then continues processing at block 400 with checking the position of the ignition switch 42.

TABLE 2

Pressure Set-point - Engine Temperature

| Engine Temperature (° C.) | Fuel Pressure Set-point (psi) |
|---|---|
| −10 | 70 |
| 0 | 65 |
| 10 | 65 |
| 20 | 58 |
| 95 | 58 |
| 100 | 65 |
| 110 | 70 |

TABLE 3

Pressure Set-point - Load vs. Speed

| Throttle | Engine Speed (RPM) | | | | |
|---|---|---|---|---|---|
| Position (%) | 8000 | 6000 | 4000 | 2000 | 1000 |
| 10 | 0 | 0 | 00 | 0 | 0 |
| 15 | 0 | 0 | 0 | 0 | 0 |
| 20 | 0 | 0 | 0 | 0 | 0 |
| 30 | 0 | 0 | 0 | 0 | 0 |

TABLE 3-continued

Pressure Set-point - Load vs. Speed

| Throttle | Engine Speed (RPM) | | | | |
|---|---|---|---|---|---|
| Position (%) | 8000 | 6000 | 4000 | 2000 | 1000 |
| 40 | 60 | 60 | 0 | 0 | 0 |
| 70 | 68 | 65 | 60 | 0 | 0 |

TABLE 4

Injector Pulse-width

| Fuel Pressure (Actual) | Injector Pulse-width (% of normal) |
|---|---|
| 25 | 152 |
| 58 | 100 |
| 64 | 95 |
| 80 | 85 |

Figure 6:
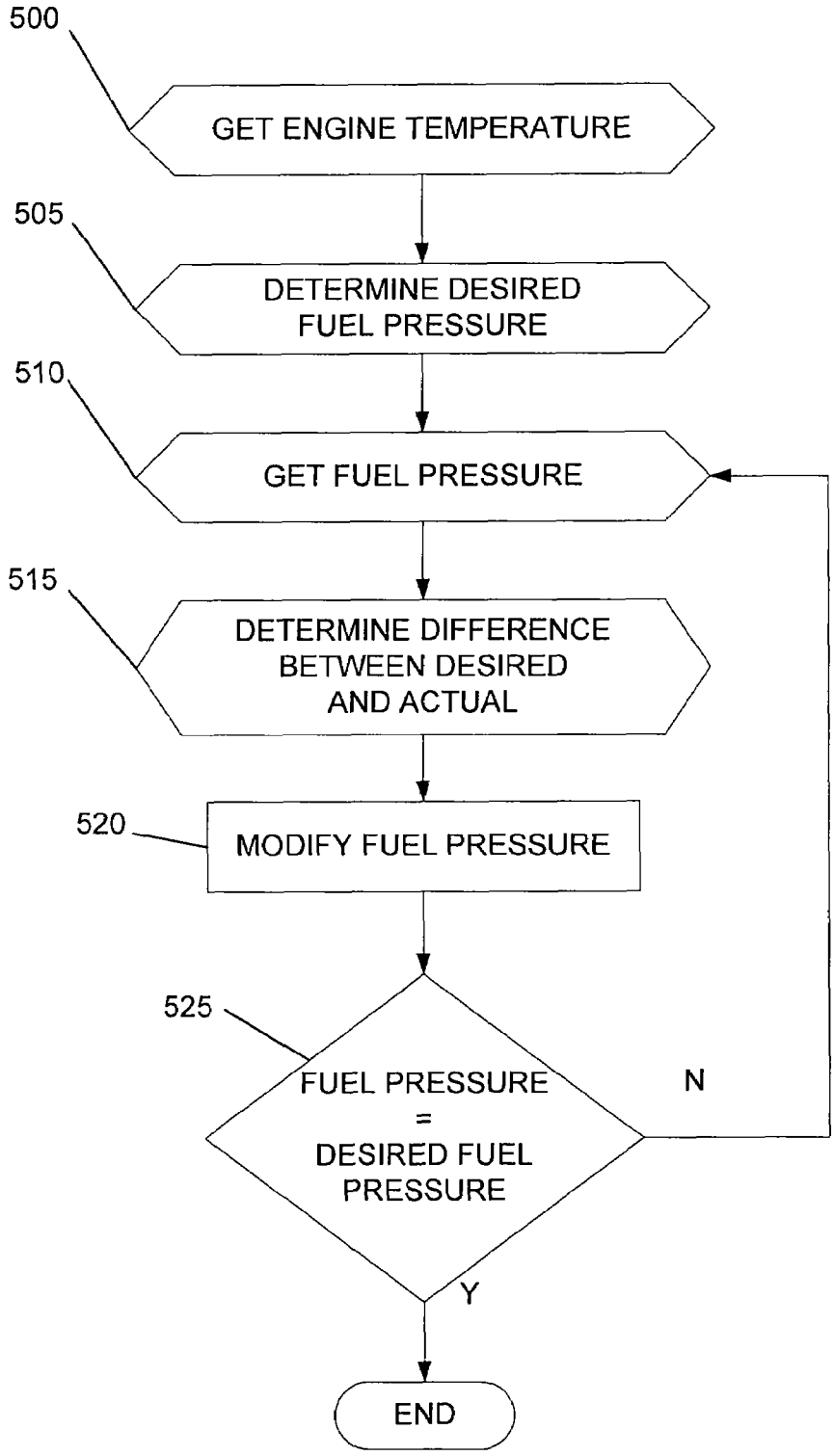
FIG. 6 illustrates a flow chart of a stop routine of the fuel delivery system of FIG. 3.

If the ECM 125 determines that the ignition switch 42 is in the stop position (block 400), the ECM 125 executes a stop routine. FIG. 6 illustrates a flow chart of an embodiment of a stop routine. The stop routine begins with the ECM 125 obtaining an indication of the engine temperature from the engine temperature sensor 135 (block 500). The ECM 125 then determines a desired fuel pressure based on the engine temperature (block 505). In some embodiments, the ECM 125 determines the desired fuel pressure based on a look-up table such as shown in Table 5. The desired pressure is chosen such that, based on the temperature of the engine, the pressure of fuel in the fuel line 150 and at the injectors 115 and 120 is sufficient to prevent the fuel from vaporizing and thereby creating a situation wherein the engine 24 is difficult to start. In other embodiments, the ECM 125 sets the desired fuel pressure to a constant (e.g., 70 psi) chosen to be sufficient to prevent fuel from vaporizing under most expected engine temperatures. The ECM 125 then determines the actual fuel pressure (block 510) based on information for the fuel pressure sensor 110 and compares the actual fuel pressure to the desired fuel pressure (block 515). Based on the difference between the actual and desired fuel pressures, the ECM 125, using a suitable control method (e.g., proportional-integral-derivative), increases or decreases the speed/torque of the fuel pump 105 to bring the actual fuel pressure in line with the desired fuel pressure (block 520). Next the ECM 125 checks if the actual fuel pressure equals the desired fuel pressure (block 525). If it does not, the ECM 125 continues at block 510 with determining the actual fuel pressure and adjusting the fuel pump as described above. If, at block 525, the actual fuel pressure equals the desired fuel pressure, the ECM 125 briefly continues to operate the fuel pump to maintain the desired fuel pressure.

TABLE 5

Stop Fuel Pressure

| Engine Temperature (° C.) | Fuel Pressure Set-point (psi) |
|---|---|
| 30 | 65 |
| 40 | 68 |
| 80 | 70 |
| 100 | 72 |

Various features and advantages of the invention are set forth in the following claims.

What is claimed is:

1. A fuel delivery system for an engine, comprising:
a fuel tank;
at least one fuel injector;
a fuel pump configured to draw fuel from the fuel tank and provide the fuel to the at least one fuel injector;
a pressure sensor configured to sense a pressure of the fuel being provided to the at least one fuel injector;
a temperature sensor configured to sense a temperature of the engine; and
an engine control module configured to control the pressure of the fuel based on the sensed pressure and the sensed temperature, the engine control module further configured to determine a stop pressure based on the temperature of the engine sensed after the engine has stopped and to control the fuel pump to provide fuel to the at least one fuel injector at the stop pressure once the engine has stopped.

2. The fuel delivery system of claim 1, wherein the fuel pump provides fuel to the at least one fuel injector prior to starting the engine at a pressure based on the detected engine temperature.

3. The fuel delivery system of claim 1, wherein the stop pressure is greater than a pressure at which the fuel vaporizes at the detected temperature of the engine.

4. The fuel delivery system of claim 1, further comprising an ignition system operable to at least in part select a start mode, a run mode, and an off mode, the ignition system providing an indication of the selected mode to the engine control module.

5. The fuel delivery system of claim 1, further comprising an engine load detector providing an indication of an engine load, and
wherein the pressure of the fuel is controlled based on the detected engine load.

6. The fuel delivery system of claim 5, wherein the engine load is determined by a throttle position.

7. The fuel delivery system of claim 6, further comprising an engine speed indicator, and
wherein a first desired fuel pressure is determined based on the detected engine temperature and a second desired fuel pressure is determined based on the detected engine load and the detected engine speed, and wherein the fuel pump is controlled to provide fuel to the at least one fuel injector at a pressure equivalent to the greater of the first desired fuel pressure and the second desired fuel pressure.

8. The fuel delivery system of claim 1, wherein a time period that the at least one fuel injector is open is determined based on the sensed pressure,
wherein the time period that the at least one fuel injector is open is increased when the sensed pressure is below a threshold, and
wherein the time period that the at least one fuel injector is open is decreased when the sensed pressure is above a threshold.

9. The fuel delivery system of claim 8, wherein the time period that the at least one fuel injector is open is modified a first amount when the sensed pressure varies from a desired pressure by more than a first predetermined amount and the time period that the at least one fuel injector is open is modified a second amount when the sensed pressure varies from a desired pressure by more than a second predetermined amount.

10. A motorcycle, comprising
an engine including at least one fuel injector;
a fuel tank;
a fuel delivery system including
a fuel pump configured to draw fuel from the fuel tank and provide the fuel to the at least one fuel injector, and
a pressure sensor;
a temperature sensor configured to sense a temperature of the engine; and
an engine control module configured to control the fuel pump based on the sensed pressure and the sensed temperature in an engine start mode and an engine run mode, wherein in the engine start mode the engine control module is configured to receive an indication to start the engine, detect the sensed temperature after receiving the indication, determine a starting fuel pressure from a start mode look up table based on the sensed temperature, control the fuel pump to provide the starting fuel pressure, and start the engine after the sensed pressure substantially equals the starting fuel pressure, and wherein in the engine run mode the engine control module is configured to determine an operating fuel pressure from a run mode look up table based on the sensed temperature, wherein the start mode look up table is different from the run mode look up table.

11. The fuel delivery system of claim 10, further comprising an engine load detector providing an indication of an engine load.

12. The fuel delivery system of claim 11, further comprising an engine speed indicator.

13. The fuel delivery system of claim 12, wherein a first desired fuel pressure is determined based on the detected engine temperature and a second desired fuel pressure is determined based on the detected engine load and the detected engine speed, and wherein the fuel pump is controlled to provide fuel to the at least one fuel injector at a pressure equivalent to the greater of the first desired fuel pressure and the second desired fuel pressure.

14. A method of delivering fuel to an engine, comprising:
detecting a fuel pressure;
detecting a temperature of an engine;
determining a fuel pressure set-point based on the detected temperature;
controlling the fuel pressure based on the detected fuel pressure and the fuel pressure set-point;
receiving an indication to stop the engine;
stopping the engine;
determining a stopped fuel pressure set-point after the engine has stopped based on the detected fuel pressure and the detected temperature after the engine has stopped, the stopped fuel pressure set-point being greater than a pressure at which the fuel vaporizes; and
controlling the fuel pressure after the engine has stopped based on the stopped fuel pressure set-point.

15. The method of claim 14, further comprising adjusting an amount of time a fuel injector is open based on the detected fuel pressure.

16. The method of claim 14, further comprising
determining a first desired fuel pressure based on a detected engine temperature,
determining a second desired fuel pressure based on a detected engine speed and a detected engine load, and
setting the fuel pressure set-point to the greater of the first desired fuel pressure and the second desired fuel pressure.

17. The method of claim 14, further comprising starting the engine after the detected fuel pressure is substantially equal to the fuel pressure set-point;

determining a desired operating fuel pressure; and transitioning the fuel pressure from the fuel pressure set-point to the desired operating fuel pressure.

18. The method of claim 17, wherein determining the desired operating fuel pressure includes determining the desired operating fuel pressure based on one of the detected temperature and a combination of a detected engine load and a detected engine speed.

19. The fuel delivery system of claim 10, wherein the transitioning from the starting fuel pressure to the operating fuel pressure is based on at least one of increments of time and increments of pressure.

* * * * *